United States Patent [19]

Kotzur

[11] Patent Number: 4,741,495

[45] Date of Patent: May 3, 1988

[54] WOUND PACKAGE OF FLEXIBLE MATERIAL

[75] Inventor: Frank W. Kotzur, Mahopac, N.Y.

[73] Assignee: Windings, Inc., Goldens Bridge, N.Y.

[21] Appl. No.: 510,186

[22] Filed: Jul. 1, 1983

Related U.S. Application Data

[63] Continuation of Ser. No. 261,882, May 8, 1981, Pat. No. 4,406,419.

[51] Int. Cl.[4] ..... B65H 55/02

[52] U.S. Cl. ..... 242/163

[58] Field of Search ..... 242/163, 168, 169, 159, 242/1, 18 R

[56] References Cited

U.S. PATENT DOCUMENTS

| | | | |
|---|---|---|---|
| 3,061,238 | 10/1962 | Taylor, Jr. | 242/163 |
| 3,178,130 | 4/1965 | Taylor, Jr. | 242/163 |
| 3,747,861 | 7/1973 | Wagner et al. | 242/163 X |
| 4,085,902 | 4/1978 | Wagner | 242/163 X |

*Primary Examiner*—Stanley N. Gilreath

*Attorney, Agent, or Firm*—Watson Cole et al.

[57] ABSTRACT

Method and apparatus for winding lengths of flexible material, packages produced by such method and apparatus, as well as endforms forming part of the mandrels on which such windings are formed, incorporate a number of winding parameters which are related to one another by a mathematical formula. Specifically, the mathematical relationship $$ym = -\frac{A}{\left[1 + \left(\frac{Gd(1+G)}{Dm}\right)^2 - \left(\frac{1+G}{2}\right)^2\right]^{\frac{1}{2}}}$$

where:

A = the guide stroke,

Gd = the guide distance from the spindle center line axis,

G = the gain or advance of the wind,

Dm = the diameter of the wind or coil, and

Ym = the wind or coil width;

governs the shape of the walls of the endform and such end-forms are used in winding apparatus for producing wound packages of flexible material. From the above equation, the geometrical shape of the wound package can also be determined.

6 Claims, 2 Drawing Sheets

WOUND PACKAGE OF FLEXIBLE MATERIAL

This application is a continuation application of application Ser. No. 261,882, filed May 8, 1981, now U.S. Pat. No. 4,406,419.

BACKGROUND OF THE INVENTION

1. Field of Invention

The invention relates to a method and apparatus for winding lengths of flexible material such as wire, rayon filaments, glass filaments, yarn, thread, rope, ribbon, tape, slit plastic sheeting, cable and the like on mandrels, and to methods of packaging such windings; to the packages produced by such method and apparatus; and to endforms forming part of the mandrels on which such windings are formed. More specifically the invention relates to the winding and forming of any bendable, filamentous or ribbon-like substance, including all cross-sectional shapes of wire or other substance and especially to materials with slippery surfaces, unusual stretch characteristics or which require minimum surface pressure and/or minimum stretching either while being wound or subsequent to winding, in packaged form.

2. Prior Art

This invention is an improvement over that disclosed in U.S. Pat. No. 3,178,130, assigned to the assignee of the subject application. The method, apparatus and packages formed by the invention of that patent are limited by the package diameters specified therein. Limitations on the package diameters were previously considered necessary because the endforms of the mandrels on which the packages were wound were designed using graphical techniques to generate the circular curve form of the endform from a center point or points lying outside of the finished package. Such a graphical and geometrical technique for generating the circular curves of the endforms causes limitations on the upper limit of the package diameters because at some point the curves of the endforms (being circular) begin to come back on themselves.

Another problem resulting from the techniques disclosed in the aforementioned U.S. patent is that the circular curves are only approximations to the exact paths that a wind builds out to as the diameter of the wind changes. If the geometrical configuration of the endforms is not correct, the ends of the wind build up causing inward slip into the valley of the wind as the wind builds on the winding core. Such inward slip eventually obscures the payout hole which is formed as a radial opening in the side of the winding extending from the exterior of the winding to the inner axial space thereof. Because in such windings formed with a radial hole, it is desirable to pay out the material from the inside of the winding through the radial opening in the payout hole, the obstruction caused by any winds in the payout hole may cause possible twist problems because the winding, as it is paid out through the radial opening, becomes entangled with the windings obscuring the payout hole.

Moreover, the obscuring of the payout hole by the slippage of the winding may present difficulty in locating the payout hole. An incorrect payout hole location will result in the material encountering a winding within the payout hole, which generally hinders paying out of the material through it.

Moreover, if the endforms of the mandrel on which the material is being wound are too wide at any point for the winding conditions, the material being wound (especially at high winding speeds) will "fall off" to a diameter which is less than that which it should be, thus causing possible tangles as the material is paid out through the payout hole formed by the radial opening in the side of the winding.

Also, if material slips to a diameter less than it should be, compression would be impossible without damaging the material and package repeatability would be lost. A loop at a diameter less than it should be must become longer because during compression the coil diameter increases slightly.

The aforementioned U.S. patent describes a design method for quick turnaround angles of the wind as it is being wound on the mandrel allowing for straight line and circular approximations. In present-day winding apparatus, different cams are available with various turnaround angles. However, with the techniques as described in the aforementioned U.S. patent, as the turnaround angles of the cams become longer (ultimately attaining a sinusoidal path) the approximations in the geometrical approach for forming endforms results in an increasing error such that the results of using the design method disclosed in the aforementioned patent produce useless and unstable winds, in addition to the aforementioned problem of limiting the diameter of the wind.

SUMMARY OF THE INVENTION

In accordance with the teachings of the present application, the design procedure for forming the wind takes into consideration at least the following winding parameters: traverse width, mandrel diameter, type of cam, diameter of endform, the advance or gain of the wind, and the guide distance from the spindle. These parameters, related to one another by mathematical formula define the process for winding the material. From the mathematical relationship in accordance with the teachings of this invention, information necessary for designing and manipulating these or other parameters pertinent to the proper winding can be obtained or derived. Furthermore, the endform of the mandrel on which the winding is wound can be derived from the aforementioned mathematical relationship.

Thus, a primary object of the invention is to produce improved supported and self-supporting coil packages of flexible material in which such flexible material can cross over itself at relatively widely spaced radial intervals to avoid destructive bends from the scissors action of close crossovers. The flexible material can be laid in helixes which form relatively small angles to the axis so that the line will payoff over the end of the wind or through the center thereof with almost no frictional resistance. The flexible material may be reversed at the end of the wound package without angular deflection, can be laid with extremely low tension but without sliding so that the flexible material will be contained under minimum pressure either on or off a supporting mandrel, and so as to avoid collapse if the support is removed and yet remain completely self-supporting so that the line can be withdrawn freely from either the center or the outside from either end, or through a radial hole extending from the exterior of the side of the wind to the inner axial space thereof.

Another object of the invention is to provide a particularly effective geometrical shape of the winding mandrel, and in particular the endform associated therewith; as well as a machine utilizing such mandrel and endform for winding a desired winding or package based on various winding parameters interrelated by a mathematical relationship.

Another object of the invention is to overcome the aforementioned difficulties of the geometrical technique utilized in the aforementioned U.S. patent and to overcome the aforementioned limitations imposed by the winding diameter of the material being wound, to prevent slippage of the winding, especially at the outer end of the wind as the wind is being wound, and to prevent obstructions from being formed in the payout hole so as to prevent tangling and to reduce the resistance of the material as it is being paid out from a finished package through a radial opening from the inside of the winding.

Yet a further object of the invention is to provide a self-supporting winding and the mandrel and endform shapes on which such winding is to be wound such that the winding parameters, for example the diameter of the coil, the coil width, the guide stroke, the guide distance from the axis of the spindle and the gain or advance, are interrelated by a mathematical relationship, thereby providing a greatly improved method for winding materials in the manner specified herein over an extended range and variation in the aforementioned winding parameters than enabled by prior art techniques, methods and apparatus.

Still another object of the invention is to provide wound packages with optimum combinations of self-supporting wind characteristics for any substance, for any particular application conditions, and for any package type or dimensions, and to provide the endform and winding dimensions as well as winding machine settings necessary for winding the material.

A further object of the invention is to provide a method for designing an improved mandrel for taking-up and paying-off any bendable substance, particularly flat or tape-like substances which heretofore have proved troublesome and which frequently have required complicated machinery for successfully winding on mandrels and endforms of current design.

While the invention, in all of its various and sundry aspects, has particular application to method, apparatus and packages of material wound in a figure-8 configuration with at least one radial hole extending from the exterior of the wind to the inner core thereof, the invention has application to other winding configurations, and in particular to windings wound in a "universal wind" as that term is known in the textile industry.

The winding of material, of the type referred to herein, in a figure-8 configuration is well known and is exemplified by the disclosures of at least the following U.S. Pat. Nos.: 2,634,922, 2,634,923, 2,716,008, 2,738,145, 2,767,938, 2,828,092, 3,178,130, 3,486,714, 3,565,365, 3,601,326, 3,655,140, 3,666,200, 3,677,490, 3,747,861 and 4,085,902, all assigned to the same assignee as the present invention.

DETAILED DESCRIPTION OF THE INVENTION

Figure 1:
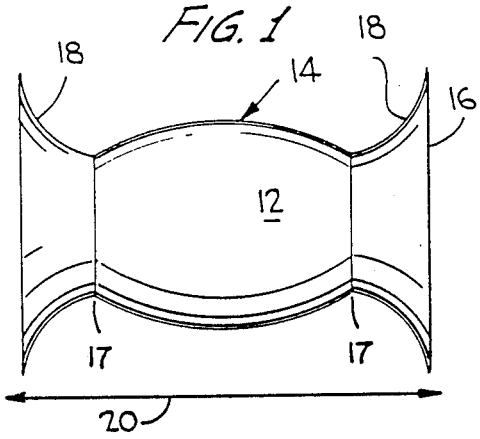
FIG. 1 is an illustration depicting an exemplary embodiment of the general form of the mandrel and endforms in accordance with the invention.

FIG. 1 illustrates a basic form of the mandrel and the endforms mounted at the ends thereof in accordance with the teachings of the invention. Mandrel 12 has a generally curved exterior surface 14 and endforms 16 having a geometrical configuration on the inner surfaces 18 thereof which are formed in a manner to be described hereinafter. A guide (not illustrated) traverses the path designated by numeral 20, with the guide traverse path being substantially parallel to the longitudinal axis of mandrel 12.

In commercial winding machines endforms 16 may be fixed to mandrel 12, or alternatively one or both of endforms 16 may be removably attached to mandrel 12. Both configurations are known to the ordinary skilled artisan familiar with the winding art to which the present invention pertains. Furthermore, the exterior surface 14 of mandrel 12 may be spherical, elliptical or any other generally curved surface which preferably slopes downwardly from the center of mandrel 12 to endforms 16. Thus it is to be understood that the configuration of the mandrel and endforms shown in FIG. 1 is only illustrative for the purposes of describing the invention and the invention is not to be construed as being limited to the mandrel and endform configuration shown in FIG. 1. Moreover, the invention described and claimed herein has application to expandable type mandrels as well as compressible mandrels and endforms known to the winding art.

Figure 2:
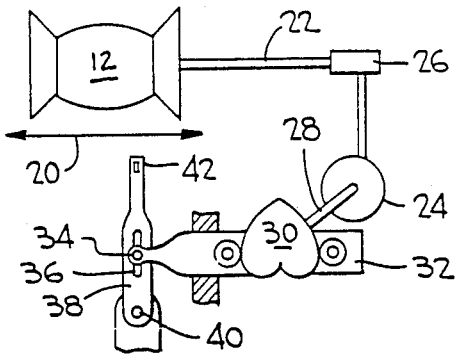
FIG. 2 (PRIOR ART)
FIG. 2 is a diagrammatic representation of apparatus known in the prior art for winding flexible material.

FIG. 2 shows a schematic representation of a prior art winding machine configuration to which the method of the present invention is adaptable. Mandrel 12 is rotatably mounted on shaft 22 driven by motor 24 through gearing 26. Motor 24 also drives shaft 28, which through a heart-shaped cam 30, drives slide 32 having pin 34 engaged in slot 36 in lever 38 pivoted at pivot point 40, and also provided with thread guide 42. Such apparatus operates in a manner well known to those skilled in the art such that a detailed description of the structure and operation thereof is not necessary to understand the present invention. Briefly, motor 24 causes rotation of shaft 22 through gear 26 such that mandrel 12 rotates about the longitudinal axis thereof at any one of a number of speeds that may be determined by the gear ratio of gear 26 and the RPM of motor 24. Heart-shaped cam 30 is also rotated by motor 24 to cause traverse guide 42 to traverse along path 20 in a reciprocating manner. The gain or advance of the wind is defined as the change in position of traverse guide 42 along path 20 with respect to the position of a reference point on mandrel 12 as the mandrel is rotated during a winding operation. The present invention also contemplates the application of variations in the gain or advance of the wind, for example in accordance with the techniques described in U.S. Pat. No. 3,666,200, also assigned to the assignee of the present invention.

Figure 3:
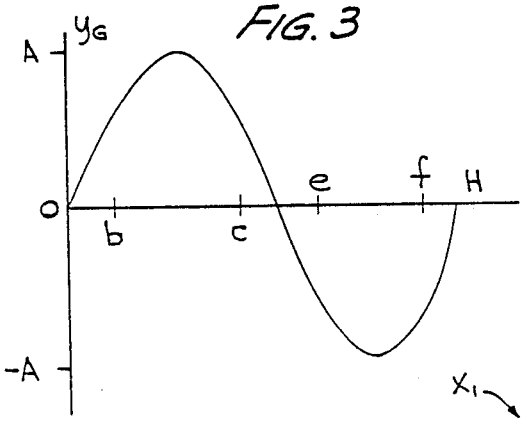
FIG. 3 is a graphical representation of the movement of the traverse in accordance with a particular exemplary cam configuration.

As heart-shaped cam 30 rotates, guide or traverse 42 moves in accordance with the exemplary graphical representation illustrated in FIG. 3. Thus, traverse 42 moves through a linear region from zero to b, c to e, and f to H. The regions b to c and e to f are described as sinusoidal. In this regard, it is noted that the method, apparatus and wound package or wind manufactured thereby in accordance with the invention are applicable to any shaped cam and are not limited to sinusoidal or quasi-sinusoidal cams.

Figure 4:
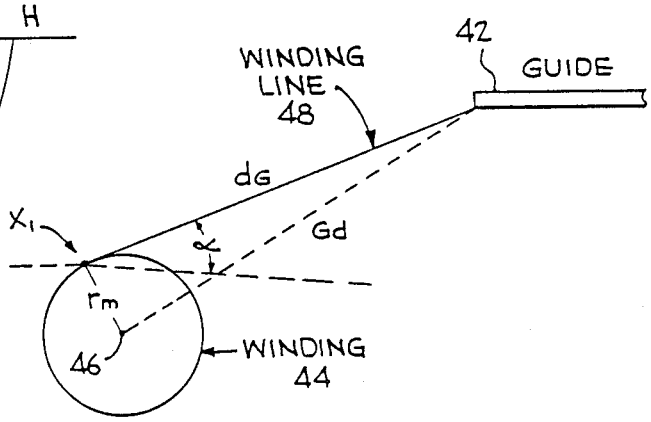
FIG. 4 is an end view of the winding apparatus illustrating the relationship of the various parameters pertinent to the development of the method and apparatus for producing a winding in accordance with the invention.

FIG. 4 illustrates an end view of the winding system wherein dG is the distance of the guide from tangent point X1 on winding 44. From Pythagorean theorem $$Gd = \sqrt{dG^2 + rm^2} \tag{1}$$

In the above equation, Gd is the distance of guide 42 from spindle axis 46 and rm is the radius of winding 44. These parameters are used in the development of the mathematical formula relating the various parameters of the wind and winding mechanism to one another, as will be set forth more fully hereinafter.

Figure 5:
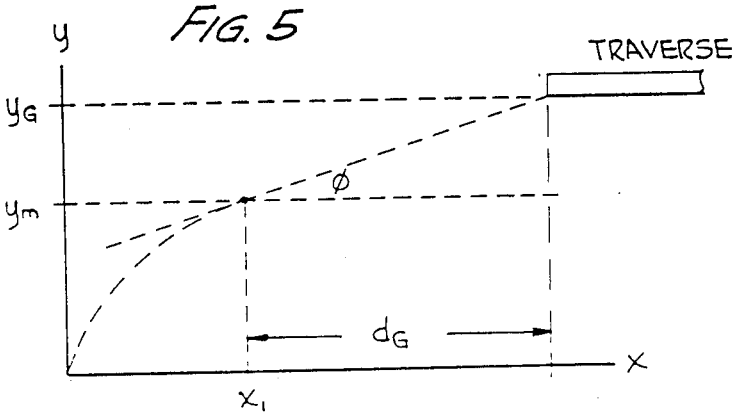
FIG. 5 is a representation of an arbitrary tracing of a winding line on a winding mandrel or winding where the line has been laid in a plane for simplicity.

FIG. 5 shows an arbitrary tracing of a wind line on a winding mandrel or winding where the line has been laid out in a plane for simplicity and purposes of explanation. The plane of the arbitrary tracing is at an angle $\phi$ (reference FIG. 4). The X axis, or abscissa, passes through the center of the winding mandrel and perpendicular to the spindle axis on which the mandrel is mounted. In FIG. 5, ym is the lay of the material on the mandrel (or winding) at any location X. yG is the location of the traverse at the point that causes ym to be where it is. X1 is the point where the winding line 48 (FIG. 4) leaves the mandrel or winding. Thus, X1 is the tangent point illustrated in FIG. 4. Although dG changes with respect to time, such a variation is not considered in the following development because such analysis is made under instantaneous conditions, where at any time rm and Gd are known, and therefore dG is known.

From a consideration of FIG. 5, it is evident that once winding line 48 leaves mandrel or winding 44 it proceeds to guide 42. The angle $\phi$ must be constant at point X1. The foregoing implies that at point X1 the material does not take a certain sharp bend.

From the above, it is seen that $$\text{Tan}\ \phi = \frac{yG - ym}{dG} \tag{2}$$

Tangent $\phi$ is the slope of the winding line from tangent point X1 to guide 42. Since the wire or material being wound is continuous with no radical bends or breaks, it is also the slope of ym evaluated at X1.

That is, $$\frac{dym}{dx}\ |X = X1 = \text{Tan}\ \phi \tag{2a}$$

$$\frac{dym}{dx} = \frac{yG - ym}{dG} = ym' \tag{2b}$$

-continued $$\text{where } y' = \frac{dym}{dx}$$

Equation 2a represents the rate of change of winding line position with respect to spacial displacement evaluated at point X1. This is equal to the slope of curve ym.

From equations 2a and 2b, the differential equation is therefore:

$$yG = dGym' + ym \tag{3}$$

Equation 3 describes the winding system under all conditions for all winding layers, gains, traverse widths, etc. From the right side of equation 3, the complementary solution is found to be:

$$(DdG + 1)\ ym = O \tag{3a}$$

D is a differential operator, namely, D=d/dx.

$$DdG + 1 = O$$

$$D = 1/dG$$

$$Yc = Cle^{-X}/\text{dG} \quad (3b)$$

It is noted that the solution of ym=yc+yP and yc is the same for all windings and depends only on initial conditions (or boundary conditions) of the winding. yP is the particular solution and depends on the type of cam used.

If yG=A sin $\omega$C X (A=one-half of the traverse stroke or width) for a cam that is sinusoidal, for example, the particular solution is $$yP = B \sin \omega C\ X + F \cos \omega CX \tag{3c}$$

Solving for B, F and ym, the results are as follows:

$$ym = Cle^{-\frac{X}{dG}} + \frac{A}{1 + d^2\omega C^2}\ [\sin\omega cX - d\omega c \cos\omega cX] \tag{4}$$

Equation 4 completely describes the path laid down for a sinusoidal cam. Note that $\omega$C is a function of footage. $\omega$C is a spacial frequency the units of which are radians per foot.

It is evident that after several feet (X) have been wound, the term $Cle^{-X}/dG$ is a very small number. For instance, if dG equals one foot, after only ten feet have been wound, $e^{-X}/dG = e^{-10} = 0.0000454$ which is close enough to zero to be insignificant, and thus can be ignored.

Allowing this condition to occur, $$ym = \frac{A}{1 + d^2\omega c^2}\ [\sin\omega cX - d\omega c \cos\omega cX] \tag{4a}$$

and taking a derivative $$y'm = \frac{A\omega c}{1 + d^2\omega c^2}\ [\cos\omega cX - d\omega c \sin\omega cX] \tag{4b}$$

we find a maximum when $$X = \frac{\tan^{-1}\left(-\frac{1}{d\omega c}\right)}{\omega c} \quad (4c)$$

from this the maximum is $$ym(\max) = -\frac{A}{(1 - d^2\omega c^2)^{\frac{1}{2}}} \quad (5)$$

From equation 1

$$d = dG = \sqrt{Gd^2 - rm^2} = \sqrt{Gd^2 - \frac{dm^2}{4}} \quad (5a)$$

where Dm equals the diameter of the winding.

Also, $$\omega c = \frac{1 + G}{dm} \quad (5b)$$

where G is the advance (gain).

Therefore, $$ym(\max) = -\frac{A}{\left[1 + \left(\frac{Gd(1 + G)}{Dm}\right)^2 - \left(\frac{1 + G}{2}\right)^2\right]^{\frac{1}{2}}} \quad (5c)$$

where:

A=the guide stroke,

Gd=the guide distance from the spindle center line axis,

G=the gain or advance of the wind,

Dm=the diameter of the wind or coil, and ym=the wind or coil width.

Thus, equation 5c relates the guide stroke, guide distance (from the spindle axis) the wind diameter and gain (advance) to the wind width. If a plot of equation 5c is made, the shape of the endform can be determined.

It is evident that if the guide distance (Gd), the diameter of the wind (Dm) and gain (G) are known, the normalized amplitude [ym(max)]/A can be found.

Equation 5c is significant because it can yield the mandrel width if the guide stroke is known, or conversely it can yield the guide stroke if the mandrel width is known as will be more apparent from the following description.

The following is a description of the manner in which an endform may be designed in accordance with the method of the invention. In a preferred exemplary embodiment of the invention, the endforms are to be designed with an eight inch diameter mandrel (the mandrel diameter being defined as the maximum width of the mandrel transverse to its longitudinal axis). The curved surface 14 of the mandrel forms a mandrel diameter of six and one-half inches at end portions 17 thereof (the portions where mandrel surface 14 joins the surface 18 of endform 16 as illustrated in FIG. 1). An eleven and one-half inch guide stroke is to be used, the endforms are eighteen inches in diameter, and traverse guide 42 is spaced one-half inch from the endforms (at the end of traverse path 20). Moreover, in this exemplary embodiment endforms 16 are designed for a system having an average advance of zero. Thus, for the conditions set forth above:

A=eleven and one-half inches,

Gd=nine and one-half inches (18 inches diameter of the endform divided by 2 plus the one-half inch guide distance), G=zero, and Dm=a variable from six and one-half inches to eighteen inches.

Since G equals zero, formula 5c reduces to:

$$ym = \frac{A}{\left[1 + \left(\frac{Gd}{Dm}\right)^2 - \frac{1}{4}\right]^{\frac{1}{2}}}$$

Letting Dm vary from six and one-half inches to eighteen inches in one-half inch steps, the parameters ym and Dm are set forth in Table I below.

TABLE I

| Dm | Ym |
|---|---|
| 6.5 | 6.77 |
| 7.0 | 7.14 |
| 7.5 | 7.49 |
| 8.0 | 7.82 |
| 8.5 | 8.13 |
| 9.0 | 8.42 |
| 9.5 | 8.69 |
| 10.0 | 8.95 |
| 10.5 | 9.18 |
| 11.0 | 9.40 |
| 11.5 | 9.61 |
| 12.0 | 9.80 |
| 12.5 | 9.98 |
| 13.0 | 10.15 |
| 13.5 | 10.31 |
| 14.0 | 10.46 |
| 14.5 | 10.59 |
| 15.0 | 10.72 |
| 15.5 | 10.84 |
| 16.0 | 10.95 |
| 16.5. | 11.06 |
| 17.0 | 11.16 |
| 17.5 | 11.25 |
| 18.0 | 11.34 |

It should be noted that when the mandrel diameter is chosen, the width is determined by equation 5d. In the above example, the mandrel width is 6.77 inches. The mandrel width being defined as the distance between points 17 (FIG. 1) and equal to the wind or coil width in the first winding layer (where the mandrel diameter also equals the wind diameter).

Figure 6:
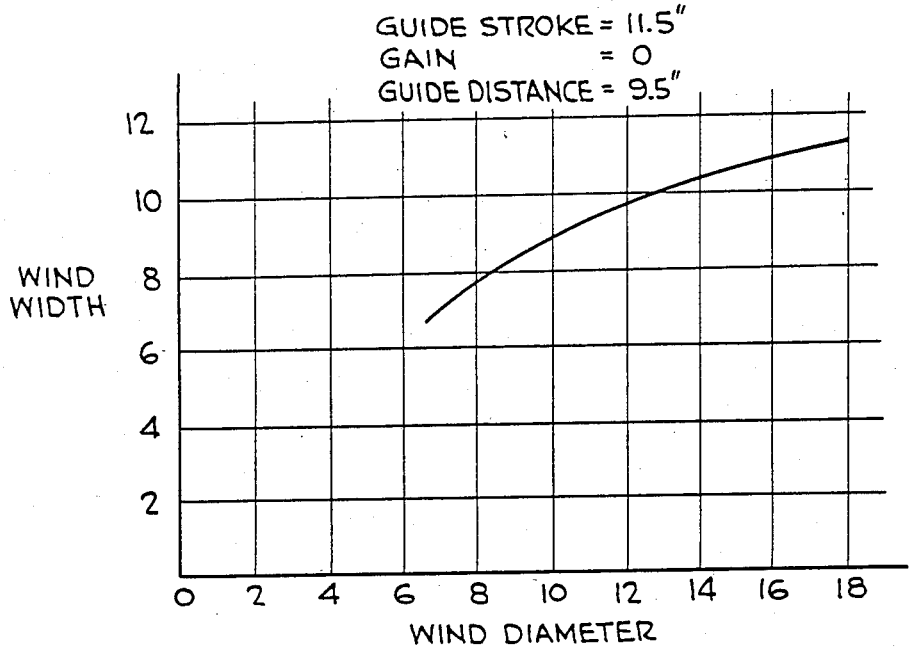
FIG. 6 is a graph of wind width versus wind diameter for certain specified parameters in accordance with a preferred embodiment of the invention.

FIG. 6 illustrates the relationship of winding width versus winding diameter for the conditions set forth in the above example, and represents the curve for the endform as generated from equation 5d in accordance with the aforementioned parameters and conditions.

Figure 7:
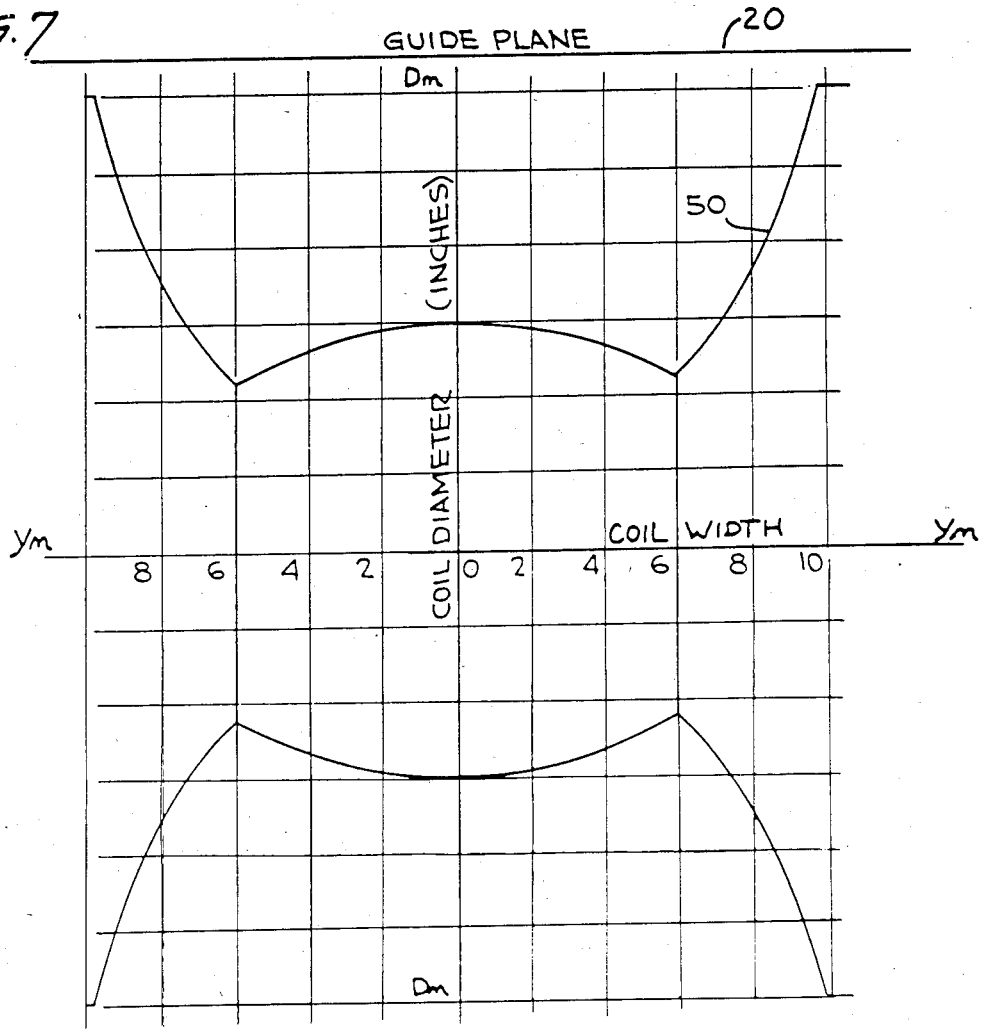
FIG. 7 illustrates the manner in which endforms are developed for a winding mandrel in accordance with the teachings of the invention.

Another example of the manner in which endforms may be designed in accordance with the teachings of the invention is illustrated in Table II and FIG. 7.

TABLE II

| Dm | Ym |
|---|---|
| 4.5 | 5.94 |
| 5.0 | 6.40 |
| 5.5 | 6.83 |
| 6.0 | 7.21 |
| 6.5 | 7.56 |
| 7.0 | 7.88 |
| 7.5 | 8.16 |
| 8.0 | 8.42 |
| 8.5 | 8.66 |
| 9.0 | 8.87 |
| 9.5 | 9.06 |
| 10.0 | 9.24 |

TABLE II-continued

| Dm | Ym |
|---|---|
| 10.5 | 9.39 |
| 11.0 | 9.54 |
| 11.5 | 9.67 |
| 12.0 | 9.79 |

In this example, the endforms have a twelve inch diameter and the mandrel has a diameter of six inches, the curved surface 18 of which (FIG. 1) brings the diameter of the mandrel to four and one-half inches at juncture 17 of surface 14 with surface 18 of endform 16 (as illustrated in FIG. 1). A guide distance of one-half inch from the endform and an advance of zero is also assumed. The guide stroke is assumed to be ten inches. Thus, A=ten inches, Gd=six and one-half inches, G=zero, and Dm=a variable from four and one-half inches to twelve inches. In this second example, the mandrel width is 5.94 inches.

FIG. 7 illustrates the curve representing the geometrical shape of the surface of the endform and the general shape of the mandrel. In FIG. 7 the coil width ym is plotted against the coil diameter Dm to obtain endform profile 50. The endform surface on the opposite side of the mandrel is simply the mirror image of endform surface 50.

By using FIG. 7 (which in actual use would be drawn to scale) and a tool used for measuring the radius of the curved surface 50 (representing the exterior surface of the endform) tooling can be used to spin or cut such curved forms out of a suitable endform material, such as aluminum or steel, etc. Numerically controlled lathes may also be used such that the endform configurations can be made by using the information set forth in Table II, which may be inserted into a programmable computer to control the lathe. More resolution can be obtained merely by solving equation 5d (or 5c) for additional points defining the curved surface of the endform.

The above examples have demonstrated the manner in which the shape of the endform can be determined from equation 5d, which is equation 5c with the gain (advance of the wind) equal to zero. However, the shape of the endform can also be determined using equation 5c for gain settings not equal to zero.

As used herein, the gain or advance of the wind is the change in the radian frequency, $\omega c$ of the traverse guide with respect to the mandrel or spindle. The gain or advance may be either positive or negative. For example, a positive gain means the radian frequency of the traverse guide is advancing with respect to the radian frequency of the mandrel. Similarly, a negative gain means that the radian frequency of the traverse guide is being retarded with respect to the radian frequency of the mandrel. The gain or advance may also be expressed as a positive or negative percentage. For example, a gain of plus 1% means that the radian frequency of the traverse guide is increasing by 1% relative to the radian frequency of the mandrel. Likewise, a negative gain or advance of minus 1% means that the radian frequency of the traverse guide is being retarded by 1% relative to the radian frequency of the mandrel or spindle.

The invention described and claimed herein has particular application to figure-8 winding configurations. A "one wind" is defined as a winding which has one figure-8 crossover in each winding layer and is produced by two revolutions of the mandrel for each complete reciprocal traverse stroke of the traverse guide. In other words, for a "one wind" the ratio of the mandrel radian frequency to the traverse guide radian frequency is equal to the integer two. Similarly, a "two wind" is a winding wound in a figure-8 configuration in which there are two figure-8 crossovers in each winding layer and the ratio of the mandrel radian frequency to the traverse guide radian frequency is equal to four. Thus, a "three wind" is a winding in which the ratio of the mandrel radian frequency to the traverse guide radian frequency is equal to six, and so on, for a "four wind", a "five wind", etc.

It is, therefore, desired that the present invention not be limited to the embodiments specifically described, but that it include all such modifications and variations that would be obvious to those skilled in this art. It is my intention that the scope of my invention should be determined by any and all equivalents of the various terms and structure as recited in the following annexed claims.

What is claimed is:

1. A package of flexible material wound in a series of figure 8's in which the crossovers of successive figure 8's are angularly displaced around the package, said package having an internal surface defining an axial opening therethrough, the wind of the package being formed by the rotation of a mandrel about a given axis and the reciprocation of a traverse guide with a selected stroke along a path spaced from, by a distance Gd and substantially parallel to, said given axis, said traverse guide winding said flexible material onto said mandrel, one complete reciprocation of the traverse guide defining a stroke A thereof, said crossovers of successive figure 8's being angularly displaced and forming at least one radial hole extending from the inner layer of the wind to the outermost layer thereof to build the wind having a wind diameter Dm and a width ym by conrolling the gain or advance G of the wind, defined as the change in the instantaneous movement of said traverse guide with respect to the instantaneous rotation of said mandrel, said package width being determined in accordance with the following formula:

$$ym = -\frac{A}{\left[1 + \left(\frac{Gd(1+G)}{Dm}\right)^2 - \left(\frac{1+G}{2}\right)^2\right]^{\frac{1}{2}}}$$

2. A package of flexible material as claimed in claim 1 wherein said internal surface includes a portion of decreasing diameter that is spherically shaped.

3. A package of flexible material as claimed in claim 2 wherein the gain or advance G is zero such that the package width is defined by the following equation:

$$ymo = -\frac{A}{\left[\left(\frac{Gd}{DM}\right)^2 + \frac{3}{4}\right]^{\frac{1}{2}}}$$

4. A package of flexible material as claimed in claim 1 wherein said internal surface includes a cylindrical central portion.

5. A package of flexible material as claimed in claim 4 wherein the gain or advance G is zero such that the package width is defined by the following equation:

$$ymo = -\frac{A}{\left[\left(\frac{Gd}{DM}\right)^2 + \frac{3}{4}\right]^{\frac{1}{2}}}$$

6. A package of flexible material as claimed in claim 1, wherein the gain or advance G is zero such that the package width is defined by the following equation:

$$ymo = -\frac{A}{\left[\left(\frac{Gd}{DM}\right)^2 + \frac{3}{4}\right]^{\frac{1}{2}}}$$

* * * * *